US011692393B2

(12) United States Patent
Zhang

(10) Patent No.: US 11,692,393 B2
(45) Date of Patent: Jul. 4, 2023

(54) ADJUSTABLE ROLLER SHADES

(71) Applicant: Jiwen Zhang, Nanyang (CN)

(72) Inventor: Jiwen Zhang, Nanyang (CN)

(73) Assignee: Nanyang Kunyuan Intelligent Technology Co., Ltd., Nanyang (CN)

( * ) Notice: Subject to any disclaimer, the term of this patent is extended or adjusted under 35 U.S.C. 154(b) by 0 days.

(21) Appl. No.: 17/901,250

(22) Filed: Sep. 1, 2022

(65) Prior Publication Data

US 2023/0070549 A1 Mar. 9, 2023

Related U.S. Application Data

(63) Continuation-in-part of application No. 17/412,004, filed on Aug. 25, 2021.

(51) Int. Cl.

| | |
|---|---|
| ***E06B 9/64*** | (2006.01) |
| ***E06B 9/68*** | (2006.01) |
| ***E06B 9/44*** | (2006.01) |

(52) U.S. Cl.

CPC ..... *E06B 9/64* (2013.01); *E06B 9/44* (2013.01); *E06B 9/68* (2013.01); *E06B 2009/6809* (2013.01)

(58) Field of Classification Search

CPC ..... E06B 2009/6809; E06B 9/64; E06B 9/42; E06B 9/74; E06B 9/68; E06B 9/72

See application file for complete search history.

(56) References Cited

U.S. PATENT DOCUMENTS 4,766,941 A * 8/1988 Sloop ..... E06B 9/72 160/310
10,577,858 B2 * 3/2020 Mullet ..... E06B 9/322

FOREIGN PATENT DOCUMENTS

CN 108533162 A * 9/2018 ..... E06B 9/40

* cited by examiner

*Primary Examiner* — Marcus Menezes
*Assistant Examiner* — Jeremy C Ramsey
(74) *Attorney, Agent, or Firm* — Ming Jiang; MM IP Services LLC

(57) ABSTRACT

The present disclosure relates to an adjustable roller shade. In certain embodiments, the adjustable roller shade includes: a roller shade fabric winding shaft, a roller shade fabric wound on the roller shade fabric winding shaft forming upper edge of adjustable roller shade, a weight bar attached to bottom of roller shade fabric forming lower edge of adjustable roller shade, a pair of movable pulleys, two pairs of upward lifting ropes and downward pulling ropes, four winders, four driving motors, and a controller. The controller controls rotations of four driving motors, independently and in concert. Each of the four winders is independently driven by four driving motors respectively. Rotations of four driving motors cause rotations of four winders. Ups and downs of the upper edge and the lower edge of the adjustable roller shade can be achieved by controlling the rotational directions of the four winders, separately and independently.

12 Claims, 4 Drawing Sheets

ADJUSTABLE ROLLER SHADES

FIELD

The invention relates to a window covering, in particular to adjustable roller shades to be freely opened and closed both from top and/or bottom.

BACKGROUND

The roller shade is convenient to use, attractive and elegant, and is widely used both in homes and office environments. The roller shades currently on the market is generally mounted at the top of the window, using a scroll to roll up and down to open the roller shades from the bottom. When such roller shades are opened partially, the lower portion of the room is exposed and natural light from the upper portion is blocked.

It is desirable to have a roller shade that can open a lower portion, an upper portion, or both lower and upper portion of the window to meet user's needs to open any portion of the window.

Therefore, an unaddressed need exists in the art to address the aforementioned deficiencies and inadequacies.

SUMMARY

In one aspect, the present disclosure relates to an adjustable roller shade. In certain embodiments, an upper edge and a bottom edge of the adjustable roller shade can be opened and closed independently. The adjustable roller shade includes: a roller shade fabric winding shaft, a roller shade fabric wound on the roller shade fabric winding shaft forms the upper edge of the adjustable roller shade, a weight bar attached to a bottom of the roller shade fabric forming the lower edge of the adjustable roller shade, a first movable pulley and a second movable pulley, a first upward lifting rope, a first downward pulling rope, a second upward lifting rope and a second downward pulling rope, a first winder, a second winder, a third winder, a fourth winder, a first driving motor, a second driving motor, a third driving motor, and a fourth driving motor, and a controller.

In certain embodiments, the roller shade fabric winding shaft includes a first end and a second end. The first movable pulley is fixedly attached to the first end of the roller shade fabric winding shaft. The second movable pulley is fixedly attached to the second end of the roller shade fabric winding shaft.

In certain embodiments, the adjustable roller shade is installed in a rectangular frame symmetrically to maintain balance of the adjustable roller shade. The roller shade fabric is also in a rectangular shape large enough to cover the rectangular frame.

In certain embodiments, each of the first winder, the second winder, the third winder, and the fourth winder are independently driven by the first driving motor, the second driving motor, the third driving motor, and the fourth driving motor, respectively.

In certain embodiments, each of the first winder, the second winder, the third winder, and the fourth winder includes: a first end and a second end.

In certain embodiments, each of the first upward lifting rope and the first downward pulling rope, and the second upward lifting rope and the second downward pulling rope comprises a first end and a second end.

In certain embodiments, each of the first upward lifting rope, the first downward pulling rope, the second upward lifting rope, and the second downward pulling rope includes: a rope, or a bead chain, or a belt.

In certain embodiments, the first upward lifting rope winds under the first movable pulley; the first downward pulling rope winds over the first movable pulley; the second upward lifting rope winds under the second movable pulley; and the second downward pulling rope winds over the second movable pulley.

In certain embodiments, the first end of the first upward lifting rope is fixedly attached to the first end of the first winder, and the first end of the second upward lifting rope is fixedly attached to second end of the first winder. The second end of the first upward lifting rope is fixedly attached to the first end of the second winder, and the second end of the second upward lifting rope is fixedly attached to second end of the second winder. The first end of the first downward pulling rope is fixedly attached to the first end of the third winder, and the first end of the second downward pulling rope is fixedly attached to second end of the third winder. The second end of the first downward pulling rope is fixedly attached to the first end of the fourth winder; and the second end of the second downward pulling rope is fixedly attached to second end of the fourth winder.

In certain embodiments, the adjustable roller shade is installed in a rectangular frame, symmetrically to maintain balance of the adjustable roller shade. The first ends of the first winder, the second winder, the third winder, and the fourth winder, and the first movable pulley are installed in a first guide frame of the rectangular frame. The second ends of the first winder, the second winder, the third winder, and the fourth winder, and the second movable pulley are installed in a second guide frame of the rectangular frame.

In certain embodiments, the controller receives a set of control commands from a control device. The control device includes: a manual control device, a control switch, and a remote control.

In certain embodiments, the set of control commands includes: rising the upper edge of the adjustable roller shade; lowering the upper edge of the adjustable roller shade; rising the lower edge of the adjustable roller shade; lowering the lower edge of the adjustable roller shade; opening completely the adjustable roller shade; and closing completely the adjustable roller shade.

In certain embodiments, when the first winder and the third winder rotate clockwise, and the second winder and the fourth winder rotate counter-clockwise, the first upward lifting rope and the second upward lifting rope are shortened, the first downward pulling rope and the second downward pulling rope are lengthened, and the upper edge of the adjustable roller shade rises.

In certain embodiments, when the first winder and the third winder rotate counter-clockwise, and the second winder and the fourth winder rotate clockwise, the first upward lifting rope and the second upward lifting rope are lengthened, the first downward pulling rope and the second downward pulling rope are shortened, and the upper edge of the adjustable roller shade lowers.

In certain embodiments, when the first winder, the second winder, the third winder and the fourth winder rotate clockwise, the roller shade fabric winding shaft rotates clockwise, and the lower edge of the adjustable roller shade lowers.

In certain embodiments, when the first winder, the second winder, the third winder and the fourth winder rotate counter-clockwise, the roller shade fabric winding shaft rotates counter-clockwise, the lower edge of the adjustable roller shade rises.

In certain embodiments, when the first winder and the third winder rotate clockwise, and the second winder and the fourth winder remain stationary, the first upward lifting rope and the second upward lifting rope are shortened, the first downward pulling rope and the second downward pulling rope are lengthened, and the upper edge of the adjustable roller shade rises.

In certain embodiments, when the first winder and the third winder rotate counter-clockwise, and the second winder and the fourth winder remain stationary, the first upward lifting rope and the second upward lifting rope are lengthened, the first downward pulling rope and the second downward pulling rope are shortened, and the upper edge of the adjustable roller shade lowers.

In certain embodiments, when the controller receives the opening completely the adjustable roller shade control command, the controller turns on the first driving motor and the third driving motor to rotate clockwise and turns on the second driving motor and the fourth driving motor to rotate counter-clockwise to rise the upper edge of the adjustable roller shade until the upper edge of the adjustable roller shade reaches a top of the rectangular frame. Then, the controller turns on the first driving motor, the second driving motor, the third driving motor, and the fourth driving motor to rotate counter-clockwise to rise the lower edge of the adjustable roller shade until the lower edge of the adjustable roller shade reaches the top of the rectangular frame.

In certain embodiments, when the controller receives the closing completely the adjustable roller shade control command, the controller turns on the first driving motor and the third driving motor to rotate clockwise and turns on the second driving motor and the fourth driving motor to rotate counter-clockwise to rise the upper edge of the adjustable roller shade until the upper edge of the adjustable roller shade reaches the top of the rectangular frame. Then, the controller turns on the first driving motor, the second driving motor, the third driving motor, and the fourth driving motor to rotate clockwise to lower the lower edge of the adjustable roller shade until the lower edge of the adjustable roller shade reaches a bottom of the rectangular frame.

These and other aspects of the present disclosure will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the disclosure and, together with the written description, serve to explain the principles of the disclosure. Wherever possible, the same reference numbers are used throughout the drawings to refer to the same or like elements of an embodiment. The drawings do not limit the present disclosure to the specific embodiments disclosed and described herein. The drawings are not necessarily to scale, emphasis instead being placed upon clearly illustrating the principles of the disclosure, and wherein.

DETAILED DESCRIPTION

Figure 1:
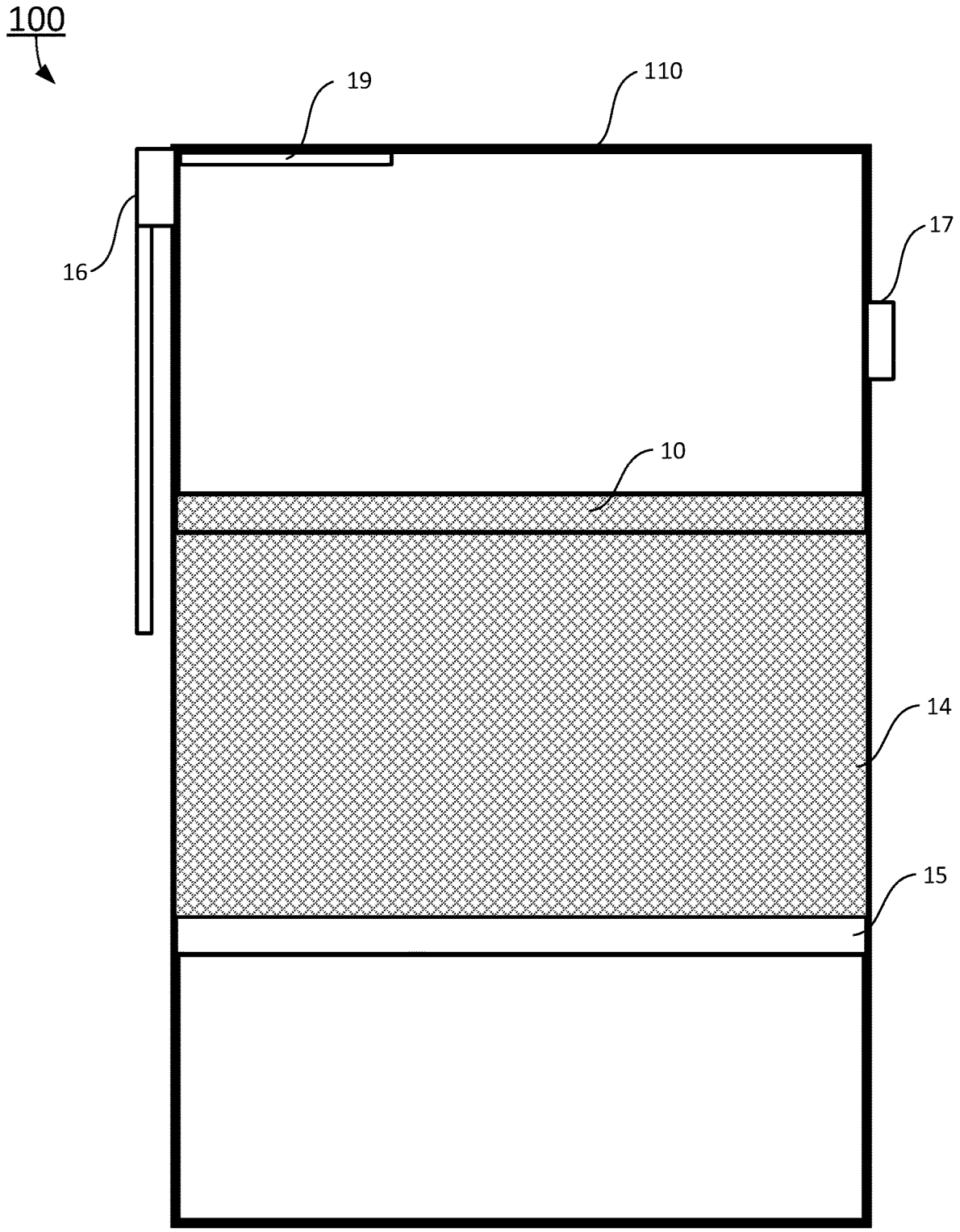
FIG. 1 is a schematic structural view of an exemplary adjustable roller shade according to certain embodiments of the present disclosure.

The present disclosure will now be described more fully hereinafter with reference to the accompanying drawings, in which exemplary embodiments of the disclosure are shown. This disclosure may, however, be embodied in many different forms and should not be construed as limited to the embodiments set forth herein. Rather, these embodiments are provided so that this disclosure will be thorough and complete, and will fully convey the scope of the disclosure to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top," and "front" or "back" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximates, meaning that the term "around", "about" or "approximately" can be inferred if not expressly stated.

Many specific details are provided in the following descriptions to make the present disclosure be fully understood, but the present disclosure may also be implemented by using other manners different from those described herein, so that the present disclosure is not limited by the specific embodiments disclosed in the following.

The description will be made as to the embodiments of the present disclosure in conjunction with the accompanying drawings FIGS. 1 through 4.

The present disclosure will now be described more fully hereinafter with reference to the accompanying drawings, in which exemplary embodiments of the disclosure are shown. This disclosure may, however, be embodied in many different forms and should not be construed as limited to the embodiments set forth herein. Rather, these embodiments are provided so that this disclosure will be thorough and complete, and will fully convey the scope of the disclosure to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top," and "front" or "back" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximates, meaning that the term "around", "about" or "approximately" can be inferred if not expressly stated.

Many specific details are provided in the following descriptions to make the present disclosure be fully understood, but the present disclosure may also be implemented by using other manners different from those described herein, so that the present disclosure is not limited by the specific embodiments disclosed in the following.

The description will be made as to the embodiments of the present disclosure in conjunction with the accompanying drawings FIGS. 1 through 4.

As shown in FIGS. 1-4, an adjustable roller shade 100 is installed in a rectangular frame 110 symmetrically to maintain balance of the adjustable roller shade 100. The adjustable roller shade 100 includes: a roller shade fabric winding shaft 10, a roller shade fabric 14 wound on the roller shade fabric winding shaft 10 forms the upper edge of the adjustable roller shade 100, a weight bar 15 attached to a bottom of the roller shade fabric 14 forming the lower edge of the adjustable roller shade 100. The roller shade fabric 14 is also in a rectangular shape large enough to cover the rectangular frame 110. The upper edge of the adjustable roller shade and the lower edge of the adjustable roller shade 100 may be adjusted according to users' desires and have the flexibilities of opening the roller shade at a top portion, a bottom portion, or both top portion and bottom portion of the rectangular frame 110.

In certain embodiments, the adjustable roller shade 100 also includes: a first movable pulley 121 and a second movable pulley 122. The roller shade fabric winding shaft 10 includes a first end 101 and a second end 102. The first movable pulley 121 is fixedly attached to the first end 101 of the roller shade fabric winding shaft 10. The second movable pulley 122 is fixedly attached to the second end 102 of the roller shade fabric winding shaft 10.

Figure 3:
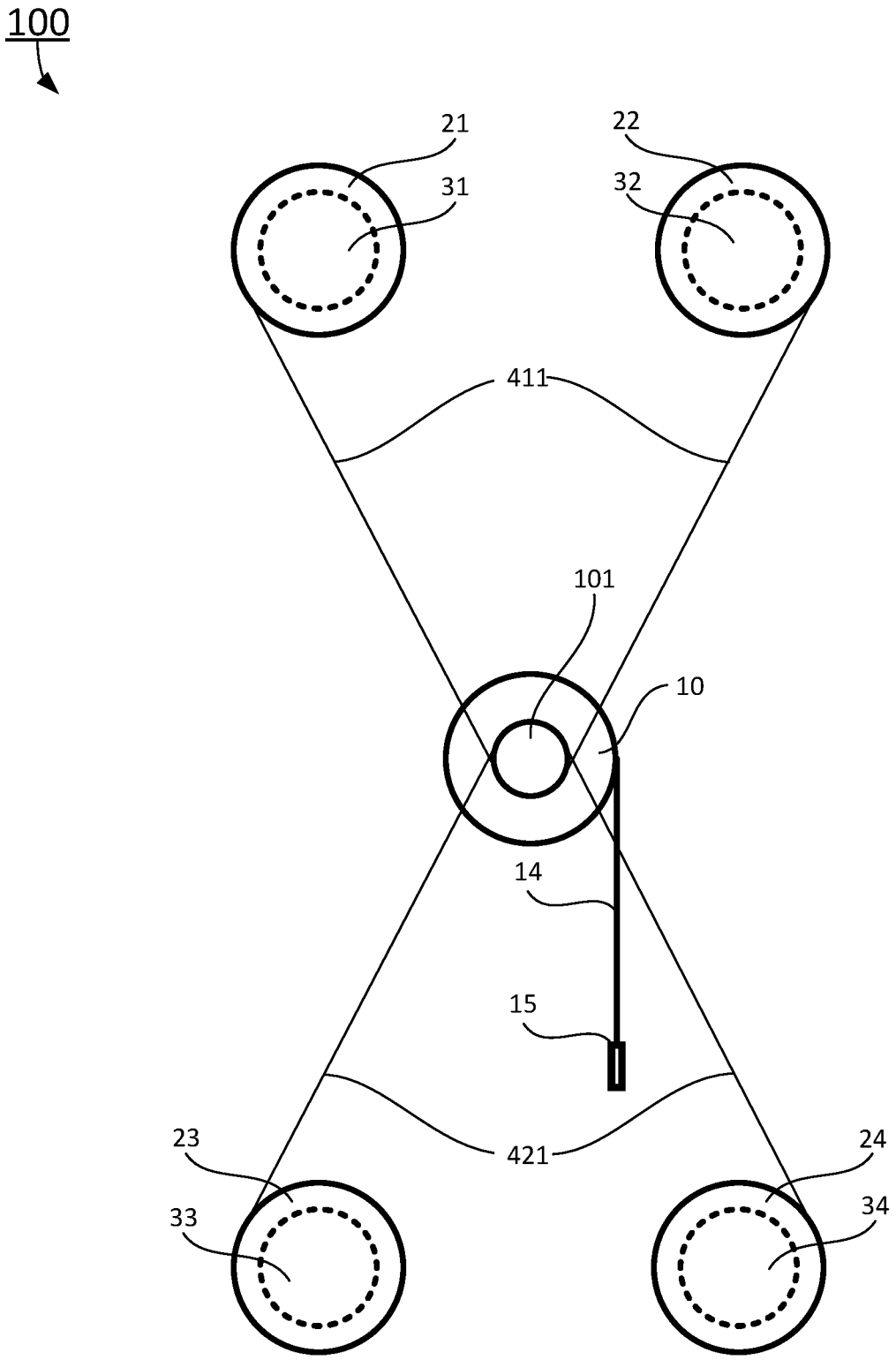
FIG. 3 is a side view of an exemplary adjustable roller shade according to certain embodiments of the present disclosure.
Figure 4:
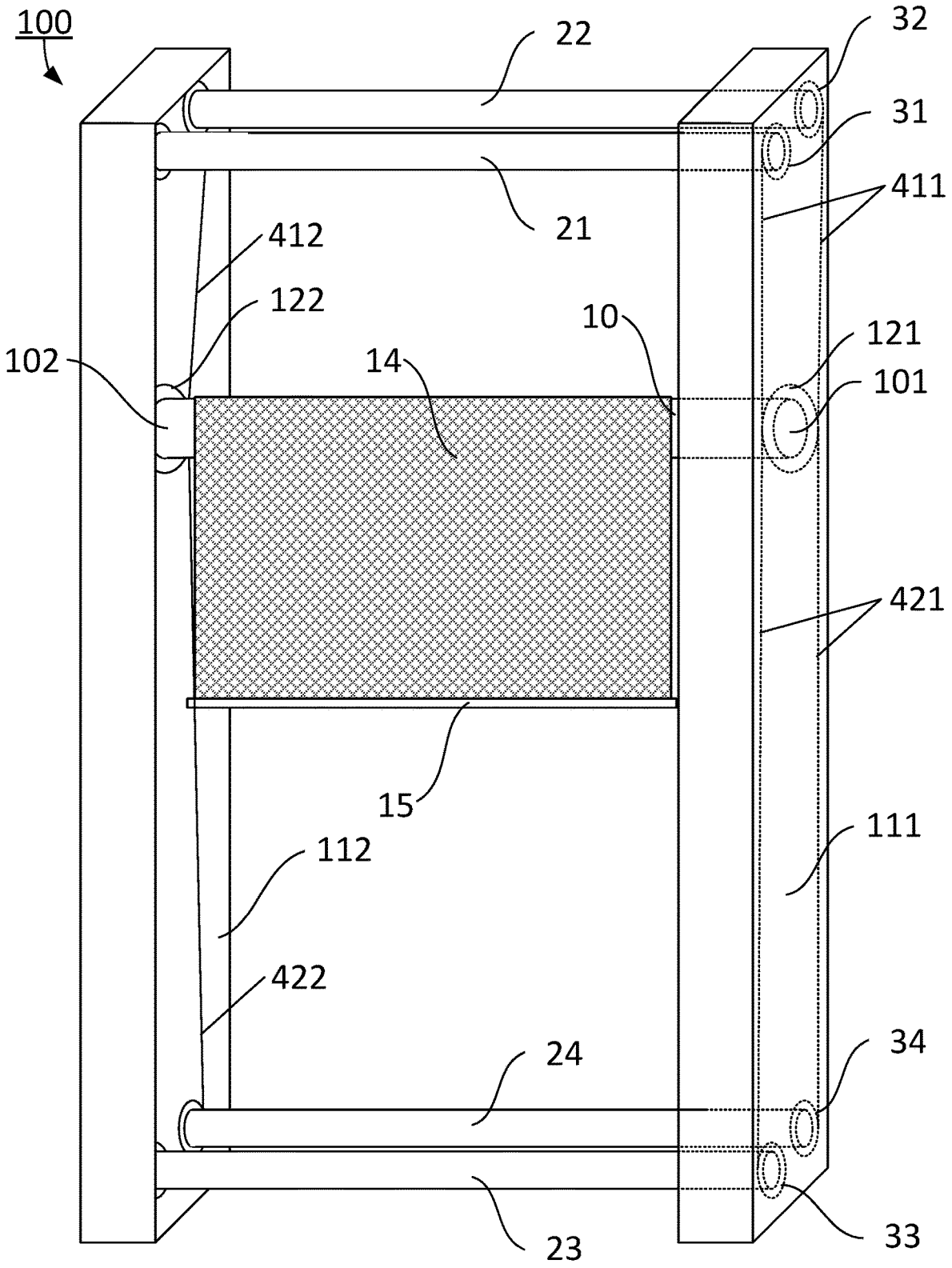
FIG. 4 is a perspective schematic view of the exemplary adjustable roller shade according to certain embodiments of the present disclosure.

In certain embodiments, as shown in FIG. 3 and FIG. 4, the adjustable roller shade 100 also includes: a first winder 21, a second winder 22, a third winder 23, and a fourth winder 24. Each of the first winder 21, the second winder 22, the third winder 23, and the fourth winder 24 is a round pole having a first end and a second end. Their lengths are about a width of the adjustable roller shade 100.

In certain embodiments, as shown in FIG. 4, the first ends of the first winder 21, the second winder 22, the third winder 23, and the fourth winder 24, and the first movable pulley 121 are installed in a first guide frame 111 of the rectangular frame 110. The second ends of the first winder 21, the second winder 22, the third winder 23, and the fourth winder 24, and the second movable pulley 122 are installed in a second guide frame 112 of the rectangular frame 110.

In certain embodiments, as shown in FIG. 3, the adjustable roller shade 100 further includes: a first driving motor 31, a second driving motor 32, a third driving motor 33, and a fourth driving motor 34. Each of the first winder 21, the second winder 22, the third winder 23, and the fourth winder 24 are independently driven by the first driving motor 31, the second driving motor 32, the third driving motor 33, and the fourth driving motor 34, respectively.

In certain embodiments, as shown in FIG. 3 and FIG. 4, the adjustable roller shade 100 also includes: a first upward lifting rope 411, a first downward pulling rope 421, a second upward lifting rope 412 and a second downward pulling rope 422. Each of the first upward lifting rope 411, the first downward pulling rope 421, the second upward lifting rope 412, and the second downward pulling rope 422 includes a first end and a second end.

In certain embodiments, the first end of the first upward lifting rope 411 is fixedly attached to the first end of the first winder 21, and the first end of the second upward lifting rope 412 is fixedly attached to second end of the first winder 21. The second end of the first upward lifting rope 411 is fixedly attached to the first end of the second winder 22, and the second end of the second upward lifting rope 412 is fixedly attached to second end of the second winder 22. The first end of the first downward pulling rope 421 is fixedly attached to the first end of the third winder 23, and the first end of the second downward pulling rope 422 is fixedly attached to second end of the third winder 23. The second end of the first downward pulling rope 421 is fixedly attached to the first end of the fourth winder 24; and the second end of the second downward pulling rope 422 is fixedly attached to second end of the fourth winder 24.

In certain embodiments, the first upward lifting rope 411 winds under the first movable pulley 121; the first downward pulling rope 421 winds over the first movable pulley 121; the second upward lifting rope 412 winds under the second movable pulley 122; and the second downward pulling rope 422 winds over the second movable pulley 122.

In certain embodiments, each of the first upward lifting rope 411, the first downward pulling rope 421, the second upward lifting rope 412, and the second downward pulling rope 422 includes: a rope, or a bead chain, or a belt.

In certain embodiments, as shown in FIG. 1, the adjustable roller shade 100 also includes: a controller 19. The controller 19 controls rotations of the first driving motor 31, the second driving motor 32, the third driving motor 33, and the fourth driving motor 34, independently and in concert. The first driving motor 31, the second driving motor 32, the third driving motor 33, and the fourth driving motor 34 drive the first winder 21, the second winder 22, the third winder 23, and the fourth winder 24 to rotate accordingly. The rotations of the first winder 21, the second winder 22, the third winder 23, and the fourth winder 24 move the upper edge and the lower edge of the adjustable roller shade 100 up or down according to control commands from a user.

In certain embodiments, the controller 19 receives a set of control commands from a control device. As shown in FIG. 1, the control device includes: a manual control device 16, a control switch 17, and a remote control 18.

In certain embodiments, the set of control commands includes at least six control commands: (1) rising the upper edge of the adjustable roller shade 100, (2) lowering the upper edge of the adjustable roller shade 100, (3) rising the lower edge of the adjustable roller shade 100, (4) lowering the lower edge of the adjustable roller shade 100, (5) opening completely the adjustable roller shade 100, and (6) closing completely the adjustable roller shade 100.

Figure 2:
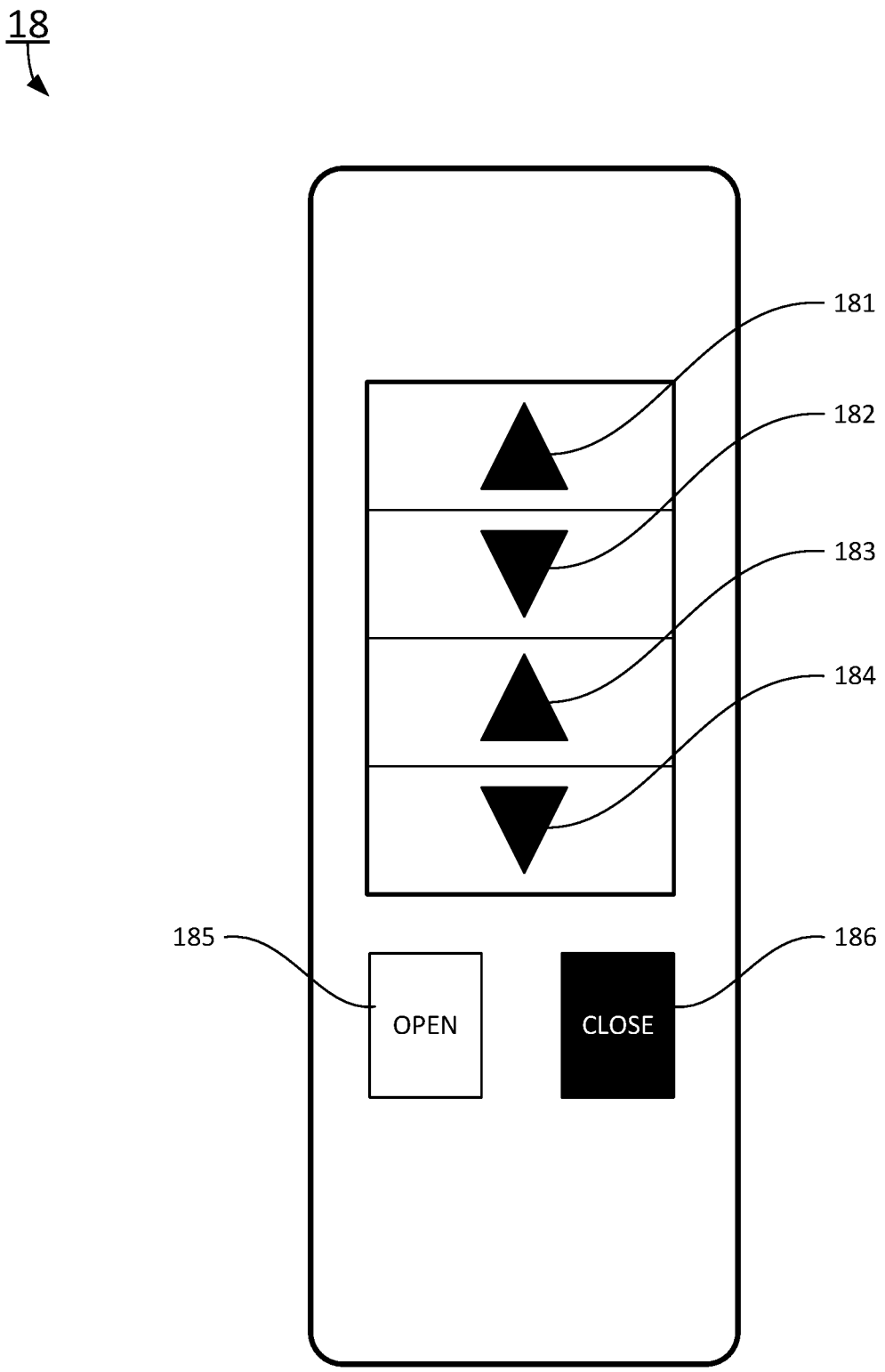
FIG. 2 is a front view of a remote control for controlling the adjustable roller shade according to certain embodiments of the present disclosure.

A front view of the remote control 18 for controlling the adjustable roller shade is shown in FIG. 2 according to certain embodiments of the present disclosure. In certain embodiments, the remote control 18 has four directional control buttons:

(1) a first up button 181 for executing the first control command: rising the upper edge of the adjustable roller shade 100;

(2) a first down button 182 for executing the second control command: lowering the upper edge of the adjustable roller shade 100;

(3) a second up button 183 for executing the third control command: rising the lower edge of the adjustable roller shade 100; and (4) a second down button 184 for executing the fourth control command: lowering the lower edge of the adjustable roller shade 100.

In certain embodiments, as shown in FIG. 2, the remote control 18 also has a one-key OPEN button 185 for executing the fifth control command: opening completely the adjustable roller shade 100, and a one-key CLOSE button 186 for executing the fifth control command: opening completely the adjustable roller shade 100. The one-key buttons 185 and 186 allow users to control the complex operations of opening and closing the adjustable roller shade 100 by pressing only one key.

In certain embodiments, as shown in FIG. 3, when the controller 19 receives the rising the upper edge of the adjustable roller shade 100 control command, the controller 19 turns on the first driving motor 31 and the third driving motor 33 to rotate clockwise and the first winder 21 and the third winder 23 rotate clockwise, and the controller 19 also turns on the second driving motor 32 and the fourth driving motor 34 to rotate counter-clockwise and the second winder 22 and the fourth winder 24 rotate counter-clockwise. The first upward lifting rope 411 and the second upward lifting rope 412 are shortened, and the first downward pulling rope 421 and the second downward pulling rope 422 are lengthened, causing the upper edge of the adjustable roller shade 100 to rise.

In certain embodiments, as shown in FIG. 3, when the controller 19 receives the lowering the upper edge of the adjustable roller shade 100 control command, the controller 19 turns on the first driving motor 31 and the third driving motor 33 to rotate counter-clockwise and the first winder 21 and the third winder 23 rotate counter-clockwise, and the controller 19 also turns on the second driving motor 32 and the fourth driving motor 34 to rotate clockwise and the second winder 22 and the fourth winder 24 rotate clockwise. The first upward lifting rope 411 and the second upward lifting rope 412 are lengthened, and the first downward pulling rope 421 and the second downward pulling rope 422 are shortened, causing the upper edge of the adjustable roller shade 100 to lower.

In certain embodiments, as shown in FIG. 3, when the controller 19 receives the lowering the lower edge of the adjustable roller shade 100 control command, the controller 19 turns on the first driving motor 31, the second driving motor 32, the third driving motor 33, and the fourth driving motor 34 to rotate clockwise and the first winder 21, the second winder 22, the third winder 23 and the fourth winder 24 rotate clockwise, causing the roller shade fabric winding shaft 10 to rotate clockwise, and the lower edge of the adjustable roller shade 100 lowers.

In certain embodiments, as shown in FIG. 3, when the controller 19 receives the rising the lower edge of the adjustable roller shade 100 control command, the controller 19 turns on the first driving motor 31, the second driving motor 32, the third driving motor 33, and the fourth driving motor 34 to rotate counter-clockwise and the first winder 21, the second winder 22, the third winder 23 and the fourth winder 24 rotate counter-clockwise, causing the roller shade fabric winding shaft 10 to rotate counter-clockwise, and the lower edge of the adjustable roller shade 100 rises.

In certain embodiments, as shown in FIG. 3, when the controller 19 receives the rising the upper edge of the adjustable roller shade 100 control command, the controller 19 turns on the first driving motor 31 and the third driving motor 33 to rotate clockwise and the first winder 21 and the third winder 23 rotate clockwise, and the controller 19 also turns off the second driving motor 32 and the fourth driving motor 34 to remain stationary and the second winder 22 and the fourth winder 24 remain stationary. The first upward lifting rope 411 and the second upward lifting rope 412 are shortened, and the first downward pulling rope 421 and the second downward pulling rope 422 are lengthened, causing the upper edge of the adjustable roller shade 100 to rise.

In certain embodiments, as shown in FIG. 3, when the controller 19 receives the lowering the upper edge of the adjustable roller shade 100 control command, the controller 19 turns on the first driving motor 31 and the third driving motor 33 to rotate counter-clockwise and the first winder 21 and the third winder 23 rotate counter-clockwise, and the controller 19 turns off the second driving motor 32 and the fourth driving motor 34 to remain stationary and the second winder 22 and the fourth winder 24 remain stationary. The first upward lifting rope 411 and the second upward lifting rope 412 are lengthened, and the first downward pulling rope 421 and the second downward pulling rope 422 are shortened, causing the upper edge of the adjustable roller shade 100 to lower.

In certain embodiments, as shown in FIG. 3, when the controller receives the opening completely the adjustable roller shade control command, the controller 19 turns on the first driving motor 31 and the third driving motor 33 to rotate clockwise and turns on the second driving motor 32 and the fourth driving motor 34 to rotate counter-clockwise to rise the upper edge of the adjustable roller shade until the upper edge of the adjustable roller shade reaches a top of the rectangular frame 110, and then, the controller 19 turns on the first driving motor 31, the second driving motor 32, the third driving motor 33, and the fourth driving motor 34 to rotate counter-clockwise to rise the lower edge of the adjustable roller shade until the lower edge of the adjustable roller shade reaches the top of the rectangular frame 110.

In certain embodiments, as shown in FIG. 3, when the controller 19 receives the closing completely the adjustable roller shade control command, the controller 19 turns on the first driving motor 31 and the third driving motor 33 to rotate clockwise and turns on the second driving motor 32 and the fourth driving motor 34 to rotate counter-clockwise to rise the upper edge of the adjustable roller shade until the upper edge of the adjustable roller shade reaches the top of the rectangular frame 110, and then, the controller 19 turns on the first driving motor 31, the second driving motor 32, the third driving motor 33, and the fourth driving motor 34 to rotate clockwise to lower the lower edge of the adjustable roller shade until the lower edge of the adjustable roller shade reaches a bottom of the rectangular frame 110.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope. Accordingly, the scope of the present disclosure is defined by the appended claims rather than the foregoing description and the exemplary embodiments described therein.

What is claimed is:

1. An adjustable roller shade, comprising:

a roller shade fabric winding shaft, wherein the roller shade fabric winding shaft comprises a first end and a second end, and a roller shade fabric wound on the roller shade fabric winding shaft forms an upper edge of the adjustable roller shade;

a weight bar attached to a bottom of the roller shade fabric forming a lower edge of the adjustable roller shade;

a first movable pulley fixedly attached to the first end of the roller shade fabric winding shaft, and a second movable pulley fixedly attached to the second end of the roller shade fabric winding shaft;

a first upward lifting rope, a first downward pulling rope, a second upward lifting rope and a second downward pulling rope;

a first winder, a second winder, a third winder, a fourth winder, a first driving motor, a second driving motor, a third driving motor, and a fourth driving motor, wherein each of the first winder, the second winder, the third winder, and the fourth winder are independently driven by the first driving motor, the second driving motor, the third driving motor, and the fourth driving motor, respectively; and a controller, wherein the controller controls rotations of the four driving motors, independently, and the rotations of the four driving motors cause rotations of the four winders to operate the upper edge and the lower edge of the adjustable roller shade, independently, wherein the controller receives a plurality of control commands from a control device, and the control device comprises: a control switch, and a remote control, wherein the remote control comprises:

a first up button configured to raise the upper edge of the adjustable roller shade, a first down button configured to lower the upper edge of the adjustable roller shade, a second up button configured to raise the lower edge of the adjustable roller shade; a second down button configured to lower the lower edge of the adjustable roller shade, an OPEN button configured to open the adjustable roller shade completely, and a CLOSE button configured to close the adjustable roller shade completely.

2. The adjustable roller shade according to claim 1, wherein each of the first winder, the second winder, the third winder, and the fourth winder comprises a first end and a second end.

3. The adjustable roller shade according to claim 2, wherein each of the first upward lifting rope, the first downward pulling rope, the second upward lifting rope, and the second downward pulling rope comprises: a first end and a second end.

4. The adjustable roller shade according to claim 3, wherein each of the first upward lifting rope, the first downward pulling rope, the second upward lifting rope, and the second downward pulling rope comprises: a rope, or a bead chain, or a belt, or combinations thereof.

5. The adjustable roller shade according to claim 4, wherein the adjustable roller shade is installed in a rectangular frame, symmetrically to maintain balance of the adjustable roller shade, wherein the first ends of the first winder, the second winder, the third winder, and the fourth winder, and the first movable pulley are installed in a first guide frame; and the second ends of the first winder, the second winder, the third winder, and the fourth winder, and the second movable pulley are installed in a second guide frame.

6. The adjustable roller shade according to claim 5, wherein the first end of the first upward lifting rope is fixedly attached to the first end of the first winder; and the first end of the second upward lifting rope is fixedly attached to second end of the first winder;

the second end of the first upward lifting rope is fixedly attached to the first end of the second winder; and the second end of the second upward lifting rope is fixedly attached to second end of the second winder;

the first end of the first downward pulling rope is fixedly attached to the first end of the third winder; and the first end of the second downward pulling rope is fixedly attached to second end of the third winder; and the second end of the first downward pulling rope is fixedly attached to the first end of the fourth winder; and the second end of the second downward pulling rope is fixedly attached to second end of the fourth winder.

7. The adjustable roller shade according to claim 6, wherein the first upward lifting rope winds under the first movable pulley;

the first downward pulling rope winds over the first movable pulley;

the second upward lifting rope winds under the second movable pulley; and the second downward pulling rope winds over the second movable pulley.

8. The adjustable roller shade according to claim 7, wherein the plurality of control commands comprises:

rising the upper edge of the adjustable roller shade;

lowering the upper edge of the adjustable roller shade;

rising the lower edge of the adjustable roller shade;

lowering the lower edge of the adjustable roller shade;

opening completely the adjustable roller shade; and closing completely the adjustable roller shade.

9. The adjustable roller shade according to claim 8, wherein when the first winder and the third winder rotate clockwise, the second winder and the fourth winder rotate counter-clockwise, the first upward lifting rope and the second upward lifting rope are shortened, and the first downward pulling rope and the second downward pulling rope are lengthened, and the upper edge of the adjustable roller shade rises;

when the first winder and the third winder rotate counter-clockwise, the second winder and the fourth winder rotate clockwise, the first upward lifting rope and the second upward lifting rope are lengthened, and the first downward pulling rope and the second downward pulling rope are shortened, and the upper edge of the adjustable roller shade lowers;

when the first winder, the second winder, the third winder and the fourth winder rotate clockwise, causing the roller shade fabric winding shaft to rotate clockwise, and the lower edge of the adjustable roller shade lowers; and when the first winder, the second winder, the third winder and the fourth winder rotate counter-clockwise, causing the roller shade fabric winding shaft to rotate counter-clockwise, the lower edge of the adjustable roller shade rises.

10. The adjustable roller shade according to claim 8, wherein when the first winder and the third winder rotate clockwise, and the second winder and the fourth winder remain stationary, the first upward lifting rope and the second upward lifting rope are shortened, and the first downward pulling rope and the second downward pulling rope are lengthened, and the upper edge of the adjustable roller shade rises;

when the first winder and the third winder rotate counter-clockwise, and the second winder and the fourth winder remain stationary, the first upward lifting rope and the second upward lifting rope are lengthened, and the first downward pulling rope and the second downward pulling rope are shortened, and the upper edge of the adjustable roller shade lowers;

when the first winder, the second winder, the third winder, and the fourth winder rotate clockwise, causing the roller shade fabric winding shaft to rotate clockwise, and the lower edge of the adjustable roller shade lowers; and when the first winder, the second winder, the third winder, and the fourth winder rotate counter-clockwise, causing the roller shade fabric winding shaft to rotate counter-clockwise, and the lower edge of the adjustable roller shade rises.

11. The adjustable roller shade according to claim 8, wherein when the controller turns on the first driving motor and the third driving motor to rotate clockwise and turns on the second driving motor and the fourth driving motor to rotate counter-clockwise to rise the upper edge of the adjustable roller shade until the upper edge of the adjustable roller shade reaches a top of the rectangular frame, and then, the controller turns on the first driving motor, the second driving motor, the third driving motor, and the fourth driving motor to rotate counter-clockwise to rise the lower edge of the adjustable roller shade until the lower edge of the adjustable roller shade reaches the top of the rectangular frame 110 such that the adjustable roller shade is opened completely.

12. The adjustable roller shade according to claim 8, wherein when the controller turns on the first driving motor and the third driving motor to rotate clockwise and turns on the second driving motor and the fourth driving motor to rotate counter-clockwise to rise the upper edge of the adjustable roller shade until the upper edge of the adjustable roller shade reaches the top of the rectangular frame, and then, the controller turns on the first driving motor, the second driving motor, the third driving motor, and the fourth driving motor to rotate clockwise to lower the lower edge of the adjustable roller shade until the lower edge of the adjustable roller shade reaches a bottom of the rectangular frame such that the adjustable roller shade is closed completely.

* * * * *